US008667637B2

(12) United States Patent
Vrdoljak et al.

(10) Patent No.: US 8,667,637 B2
(45) Date of Patent: Mar. 11, 2014

(54) STEAM APPLIANCE WITH DIFFUSER

(75) Inventors: Ognjen Vrdoljak, Laval (CA); Charles Boulos, Milford, MA (US)

(73) Assignee: Euro-Pro Operating LLC, Newton, MA (US)

( * ) Notice: Subject to any disclaimer, the term of this patent is extended or adjusted under 35 U.S.C. 154(b) by 998 days.

(21) Appl. No.: 12/651,162

(22) Filed: Dec. 31, 2009

(65) Prior Publication Data

US 2010/0186463 A1 Jul. 29, 2010

Related U.S. Application Data

(60) Provisional application No. 61/142,298, filed on Jan. 2, 2009.

(51) Int. Cl.
*A47L 13/10* (2006.01)

(52) U.S. Cl.
USPC ..... 15/229.3; 15/228; 15/320

(58) Field of Classification Search
USPC ..... 15/320, 104.001, 118, 128, 231, 228, 15/229.3–229.9
See application file for complete search history.

(56) References Cited

U.S. PATENT DOCUMENTS 4,181,255 A 1/1980 Cort
4,828,542 A 5/1989 Hermann
7,774,894 B2 * 8/2010 Rippl et al. ..... 15/320
7,891,047 B2 * 2/2011 Milanese ..... 15/320
2002/0176949 A1 11/2002 Hokkirigawa et al.
2008/0034514 A1 2/2008 Rosenzweig et al.
2008/0066789 A1 3/2008 Rosenzweig et al.
2008/0236635 A1 10/2008 Rosenzweig et al.
2010/0037495 A1 2/2010 Rosenzweig et al.
2010/0116298 A1 5/2010 Rosenzweig et al.
2010/0212098 A1 8/2010 Vrdoljak

FOREIGN PATENT DOCUMENTS

EP 1 980 192 A2 10/2008

OTHER PUBLICATIONS

International Search Report and Written Opinion for PCT/US2009/069943 mailed Jun. 9, 2010.

* cited by examiner

*Primary Examiner* — Dung Van Nguyen
(74) *Attorney, Agent, or Firm* — Wolf, Greenfield & Sacks, P.C.

(57) ABSTRACT

A diffuser with an absorbent substrate for holding a steam diffusible composition, such as a fragrance for mounting on a steam frame of a steam appliance is provided. The steam appliance has a water pump for selectively injecting water from a reservoir to a boiler to generate steam fed into a steam frame with a fabric pad or steam pocket mounted thereon. The steam envelopes the diffuser to dispense a fragrance or other material in the absorbable substrate into the generated steam in response to a user use or movement of the appliance. When steam is generated and passes the diffuser, the composition is heated to a temperature it will vaporize and be distributed with the steam through the fabric pad or steam pocket.

8 Claims, 14 Drawing Sheets

STEAM APPLIANCE WITH DIFFUSER

CROSS REFERENCE TO RELATED APPLICATIONS

This application is based on and claims the benefits of U.S. provisional application Ser. No. 61/142,298, filed Jan. 2, 2009.

BACKGROUND OF THE INVENTION

The invention relates generally to steam appliances, and more particularly to steam appliances including a fragrance diffuser that emits a fragrance or other vapor when the appliance generates steam.

Steaming devices used to apply steam to household objects are well known. The uses of the devices vary widely, and may include the application of steam to drapes or other fabrics to remove wrinkles, and the application of steam to objects to assist in cleaning the various objects and surfaces.

In general, nozzles used with the steam appliances do not have large surface areas and a cloth or fabric pad is placed over a steam frame to provide an enlarged steaming or cleaning surface. The fabric pad may have hook and loops fasteners, such as Velcro strips to secure the fabric to cleats on the nozzle. Alternatively, a fabric steam pocket may be placed around a flat steam frame with baffles in order to increase the cleaning surface area of the appliance.

Recently, steam appliances have been developed where water is pumped from a water reservoir to a boiler in response to the push-pull movement of the appliance. This movement actuates a mechanical or electrical pump to pump water from the water reservoir to a steam generator in the appliance for feeding steam to the fabric pad or pocket. Examples of these features in steam appliances are shown and described in parent application Ser. No. 11/496,143 and Ser. No. 11/769,525. Hand-held devices include steam brushes with mechanical or electrical pumps as shown in U.S. application Ser. No. 12/540,957, or electrical pumps as shown in Ser. No. 12/617,518. Additionally, the appliance may have a rigid steam frame for installing a fabric pad or fabric steam pocket as shown in these applications, or have a flexible steam frame as shown in Ser. No. 12/554,477. The contents of each of these applications are incorporated here by reference in their entirety.

Notwithstanding the wide variety of steam appliances with various types of steam frames available, it remains desirable to provide additional steam products having improved features, such as emitting a vapor or fragrance when desired.

SUMMARY OF THE INVENTION

Generally speaking, in accordance with the invention, a fragrance diffuser for use with a steam appliance is provided. The fragrance diffuser includes an absorbent substrate for holding a steam diffusible composition for placement between the appliance steam outlet and a fabric pad or pocket used with the appliance. The steam appliance has a water pump for selectively injecting water from a reservoir to a boiler to generate steam that envelopes the diffuser to dispense a fragrance or other material into the generated steam in response to a user use or movement of the appliance. The absorbent substrate may be mounted on a base or clip for mounting on the steam frame, or the substrate itself may be formed into a unitary clip to mount onto the steam frame. Alternatively, the diffuser may be formed from a carrier having a base with a clip and a perforated plate hinged to the base for holding an absorbent pad or substrate. The base is mounted to the appliance, preferably at the steam frame behind the fabric pad or pocket.

The user may actuate the water pump by movement of the appliance to activate a mechanical pump piston, or actuate a motion switch or micro-switch, in response to the movement of the appliance. Water is pumped to a steam generator and the steam generated is distributed through a steam outlet or nozzle in the steam frame for steaming. As the steam passes the diffuse, it raises the temperature of the substrate to release the fragrance or other composition absorbed therein. The steam with fragrance is then passed through the fabric steam pad or steam pocket mounted on the steam frame to provide improved steaming The diffuser is formed from a porous substrate impregnated with a fragrance or other composition that is activated at or below steam temperature. The diffuser is placed in the towel frame between the steam outlet and the fabric towel. Steam generated in the boiler passes over the diffuser to vaporize the fragrance or other composition for dispensing through the fabric towel with the steam.

Accordingly, it is an object of the invention to provide an improved steam appliance.

Another object of the invention is to provide an improved steam appliance having a fragrance diffuser between the steam outlet and fabric pad or pocket to dispense a fragrance or other composition in the diffuser when the appliance is in use.

A further object of the invention is to provide a fragrance diffuser in the form of a clip for use with a steam appliance.

Yet another object of the invention is to provide a steam appliance with fragrance dispenser that pumps water to a steam generator in response to movement of the appliance.

Still other objects and advantages of the invention will in part be obvious and will in part be apparent from the specification.

The invention accordingly comprises a product possessing the features, properties, and the relation of components which will be exemplified in the product hereinafter described, and the scope of the invention will be indicated in the claims.

BRIEF DESCRIPTION OF THE DRAWINGS

For a fuller understanding of the invention, reference is made to the following description taken in connection with the accompanying drawing(s), in which.

DETAILED DESCRIPTION OF THE INVENTION

Figure 1:
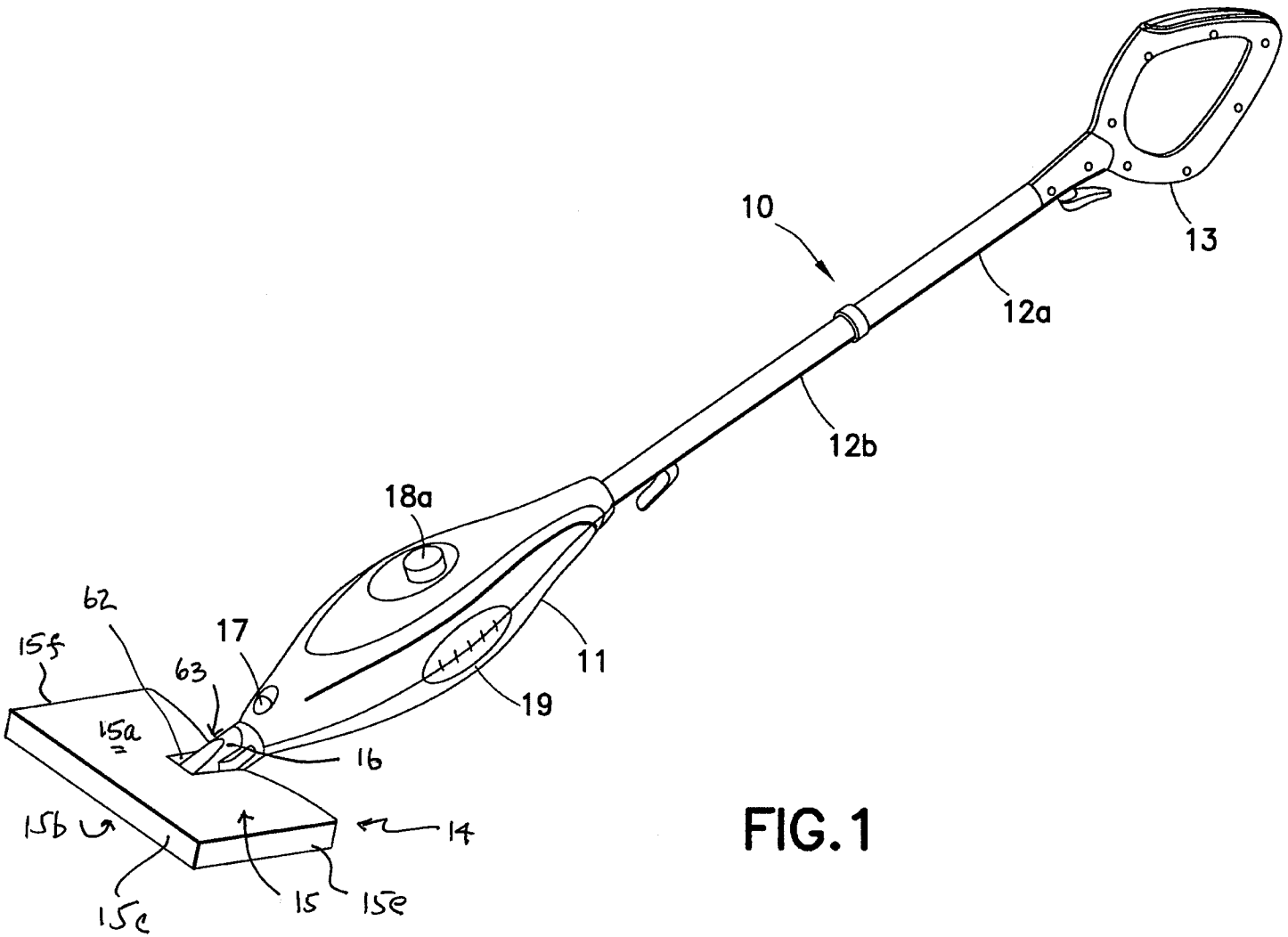
FIG. 1 is a perspective view of a steam mop constructed and arranged in accordance with one embodiment of the invention.

FIG. 1 is a perspective view of a steam mop 10 constructed and arranged in accordance with the invention. Mop 10 includes an elongated housing 11 with a water reservoir 21 and a boiler 23 and an upper tube 12*a* and a lower tube 12*b* connected to one end of housing 11. A handle 13 is attached to the end of upper tube 12*a*. A steam frame 14 with an installed steam pocket 15 is operatively connected to the other end of housing 11 by a connector 16. In this embodiment, connector 16 and frame 14 may be removed from housing 11 by pressing a release button 17 at the base of housing 11. Water is introduced into a reservoir 21 at a water inlet or opening 18*a*. The level of water present in a reservoir 21 in housing 11 shown in FIG. 3 can be viewed through a sighting window 19. The specifics of fabric steam pocket 15 will be described below.

Figure 2A:
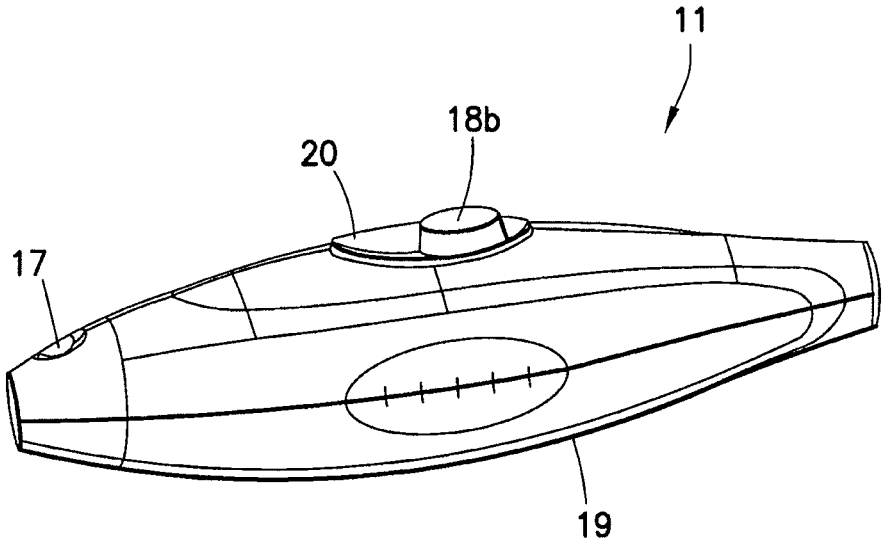
FIGS. 2A and 2B are perspective side views of the mop housing in the steam mop of FIG. 1 showing the water inlet and funnel.
Figure 2B:
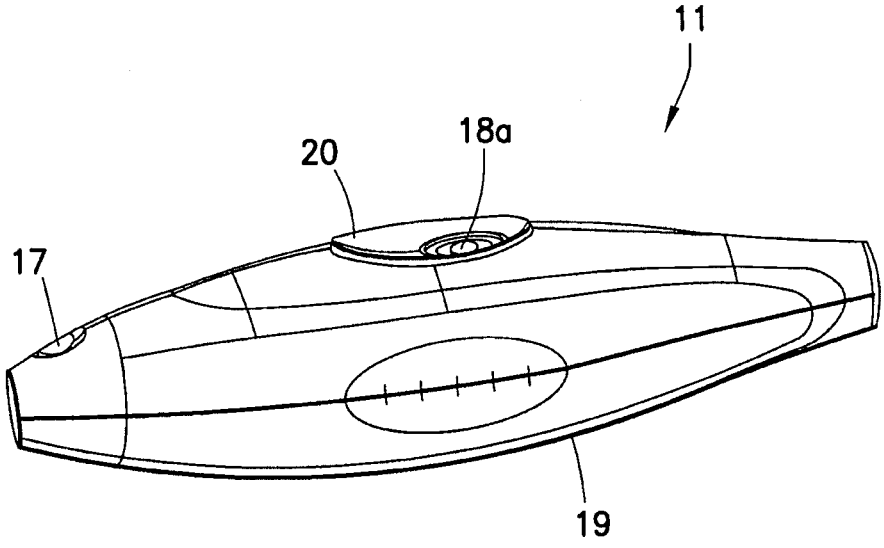

FIGS. 2A and 2B are perspective side views of housing 11. Water inlet 18*a* has a water cap 18*b* that is removed for filling to exposed opening 18*a*. The region around opening 18*a* is shaped like a funnel 20 allows a user to fill reservoir 21 without spilling. Housing 11 also includes at least one sighting window 19 that allows a user to observe the water level in water container 21.

Figure 3:
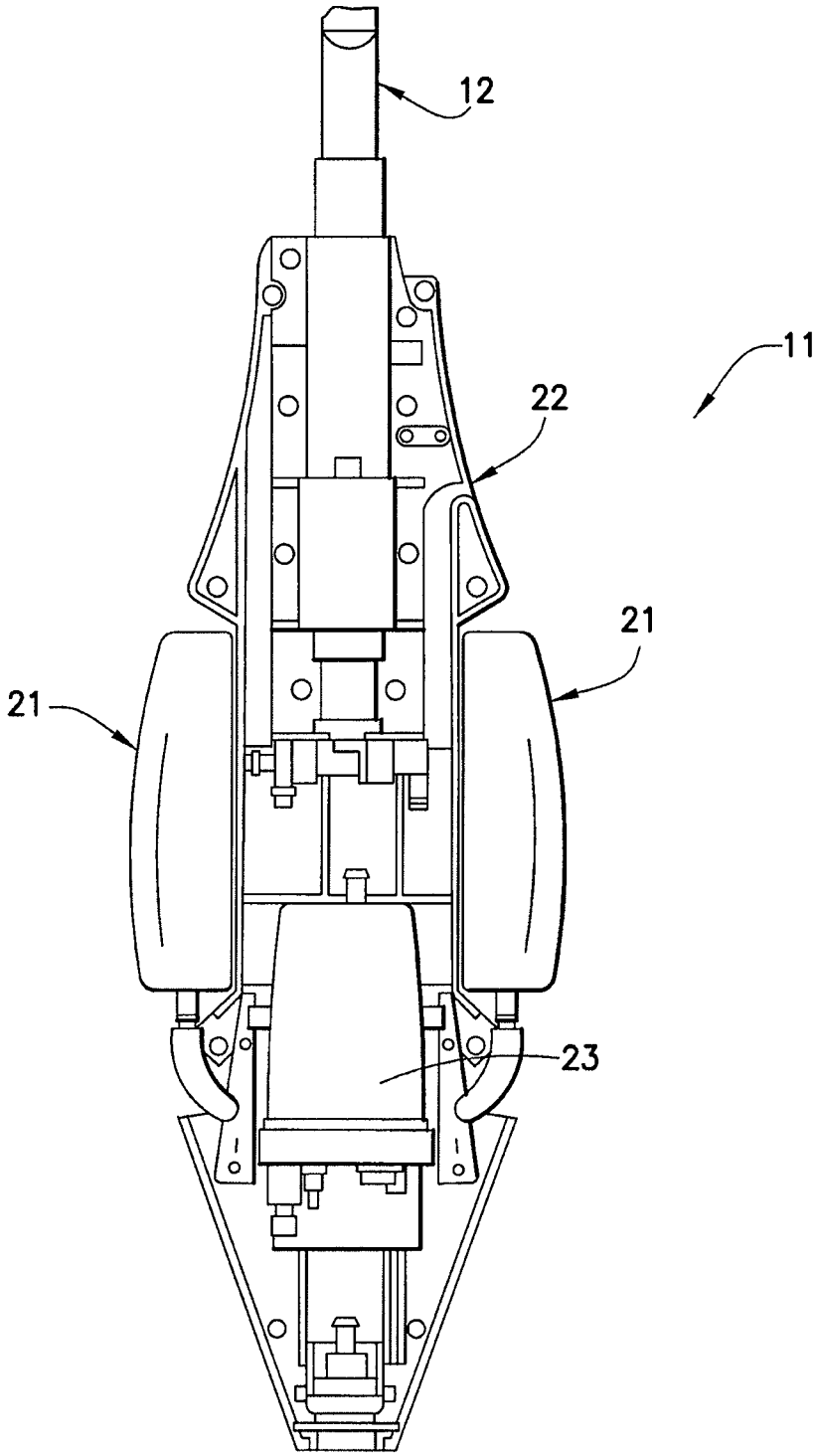
FIG. 3 is a front view of the mop housing in section showing a reservoir, a pump and a boiler of FIG. 1.

FIG. 3 is a front plan view in section showing the location of elements in housing 11. Water container 21 is positioned adjacent and surrounds a boiler 23. A one-way pump 22 pumps water from reservoir 21 to boiler 23 in response to the push-pull movement of mop 10. This movement of handle 13 causes operation of one way valve 22 as will be described in detail below. Here, water container 21 wraps around the back of housing 11.

Figure 4:
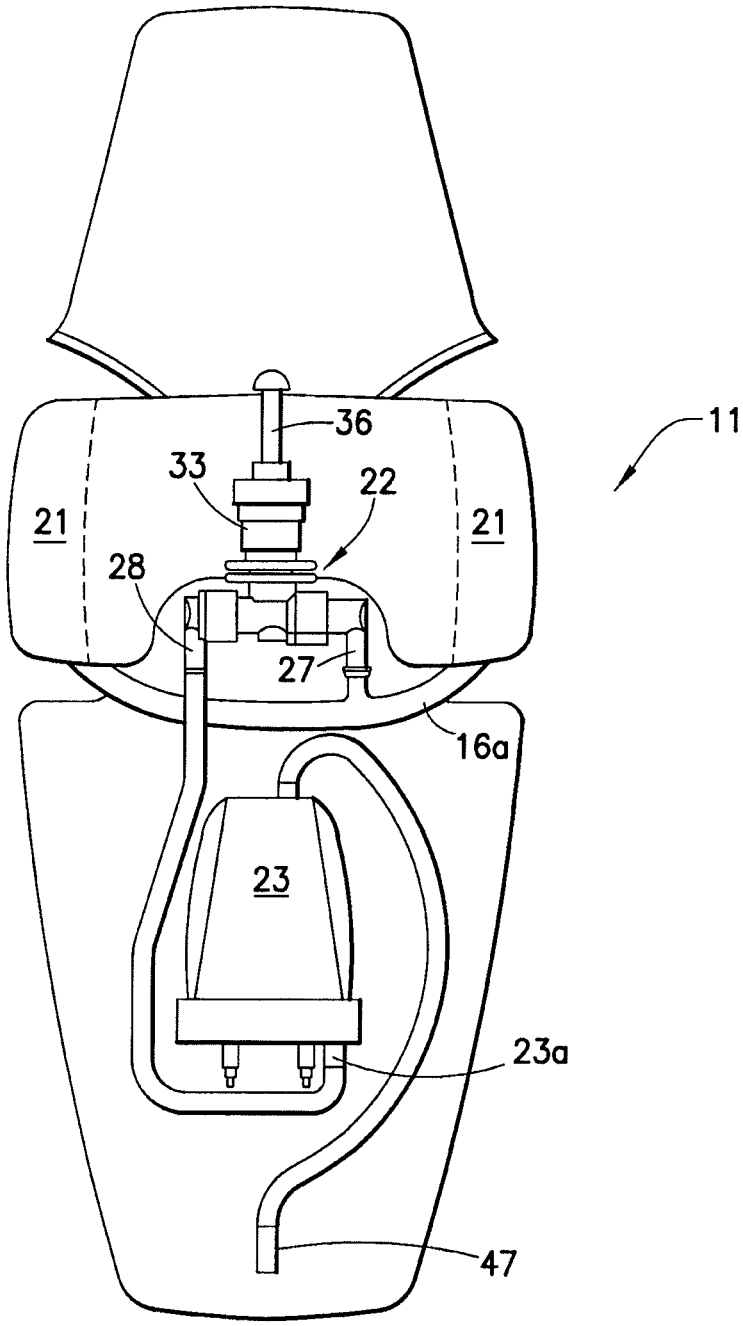
FIG. 4 is a front elevational view of the mop housing in section showing connections for reservoir, boiler and steam mop frame in accordance with one embodiment of the invention.
Figure 5:
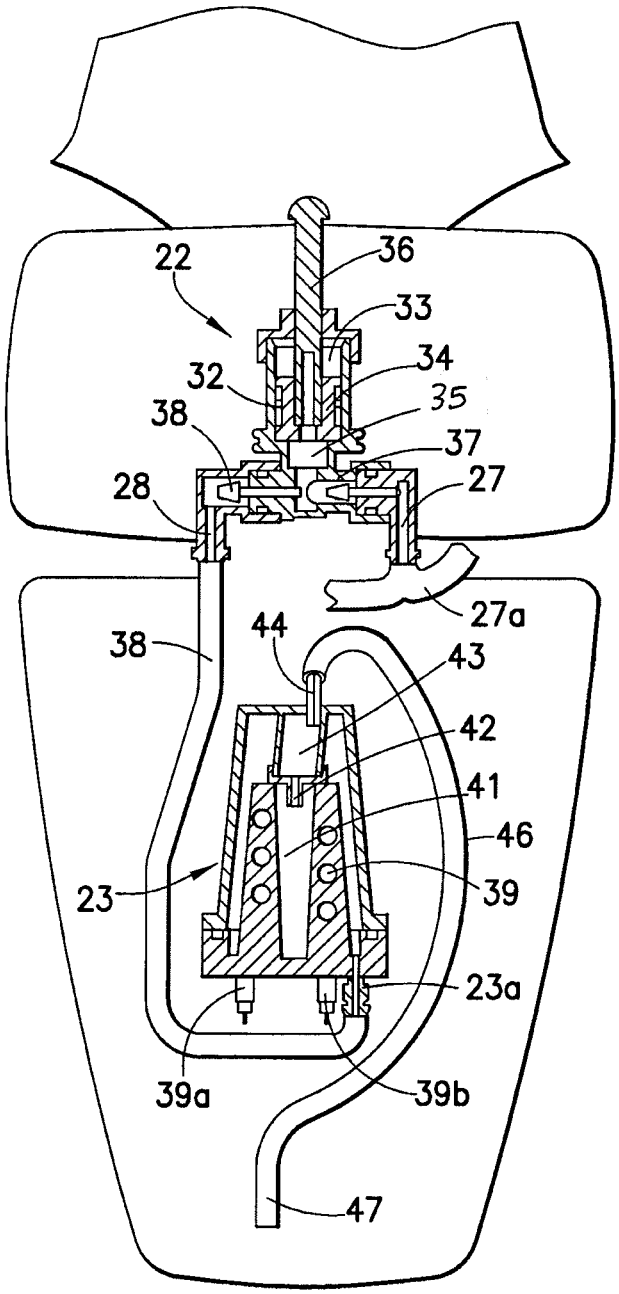
FIG. 5 is an elevation view in section of the pump and boiler of FIG. 5.

FIG. 4 is a detailed front view of showing how water container 21, showing the hoses connecting one-way pump 22 and boiler 23 as described in connection with FIG. 5. Water pump 22 includes a pump body 33 having a pump cavity. A pump piston 34 is connected to a push rod 36 which in turn is connected to pole 12 or handle 13. As mop handle 13 is pulled by a user piston 34 creates a negative pressure in the pump cavity. This draws water from reservoir 21 into a water supply hose that feeds into pump water inlet 27 through a one-way inlet valve 37 to fill cavity 33*a*. As handle 13 is pushed during use, piston 34 moves downward and water in the pump cavity is expelled through a one-way outlet valve 38 into pump outlet hose 28. This water is then introduced into a boiler inlet 23*a* in boiler 23. Water in boiler 23 is heated by a heating element 39 in a boiler cavity 41. Heating element 39 is connected to electrical connectors 39*a* and 39*b*. Steam generated in boiler cavity 41 is fed through a steam valve 42 into a steam chamber 43. Steam is then expelled through a steam outlet 44 to a steam hose 46 and to a steam outlet fitting 47.

One-way inlet valve 37 and one-way outlet valve 38 are duck-bill valves formed of a flexible elastomeric material, such a rubber. The valves are conical in shape so that when handle 13 is pulled, water is drawn through inlet valve 37 while outlet valve 38 remains closed. Similarly, when handle 13 is pushed, water is forced out through outlet valve 38 and inlet valve 37 remains closed and water is fed into boiler 23. In another embodiment, a mechanical bellow pump that may be used in steam mop housing 11 to pump water from water container 21 to boiler 23. Alternatively, the pump can be a two-way piston pump that pumps water when its piston is displaced both in the forward direction and also in the return backwards motion. This type of pump is shown in co-pending application Ser. No. 11/842,478. The contents of which are incorporated herein by reference in its entirety.

Fabric steam pocket 15 is configured to slip over frame 14 in accordance with one embodiment of the present invention. In this respect, pocket 15 is formed of a first layer of fabric 15*a* and an opposed second layer of fabric 15*b* (not shown). Fabric layers 15*a* and 15*b* each have a substantially rectangular shape with two opposed long edges 15*c* and 15*d* and two opposed short sides 15*e* and 15*f*. Long edge 15*c* and two opposed short side 15*e* and 15*f* are stitched to form pocket 15. Accordingly, fabric steam pocket 15 is open on long edge 15*d*. The fabric along the opening on long edge 15*d* may be optionally closed with a hook and loop fastener, buttons or snaps. Here, steam pocket 15 is cut along a line 62 to form a slot 63 around the width of connector 16 on the first layer 15*a* and opposed second layer 15*b* to fit around connector body 16. Slot 63 has a length a distance 62*a* from rear edge 15*d* to about the pair of nozzles 16*c* shown in FIG. 7. This allows for vertical rotation of housing 11 without bending the fabric of fabric steam pocket 15 and use of both sides of steam pocket 15 for cleaning without having to remove and re-install steam pocket 15.

In this illustrated embodiment, steam pocket 15 is a cloth or towel. Steam pocket may be formed of any suitable fabric such as a natural or synthetic fabric material. Accordingly, it may be polyester, acrylic, polyamide or polyolefin fiber, or a blend. The material may be woven or knit. Preferably, the fabric of pocket 15 is a microfiber. Most preferably, the microfiber includes a synthetic polyester microfiber.

Figure 6:
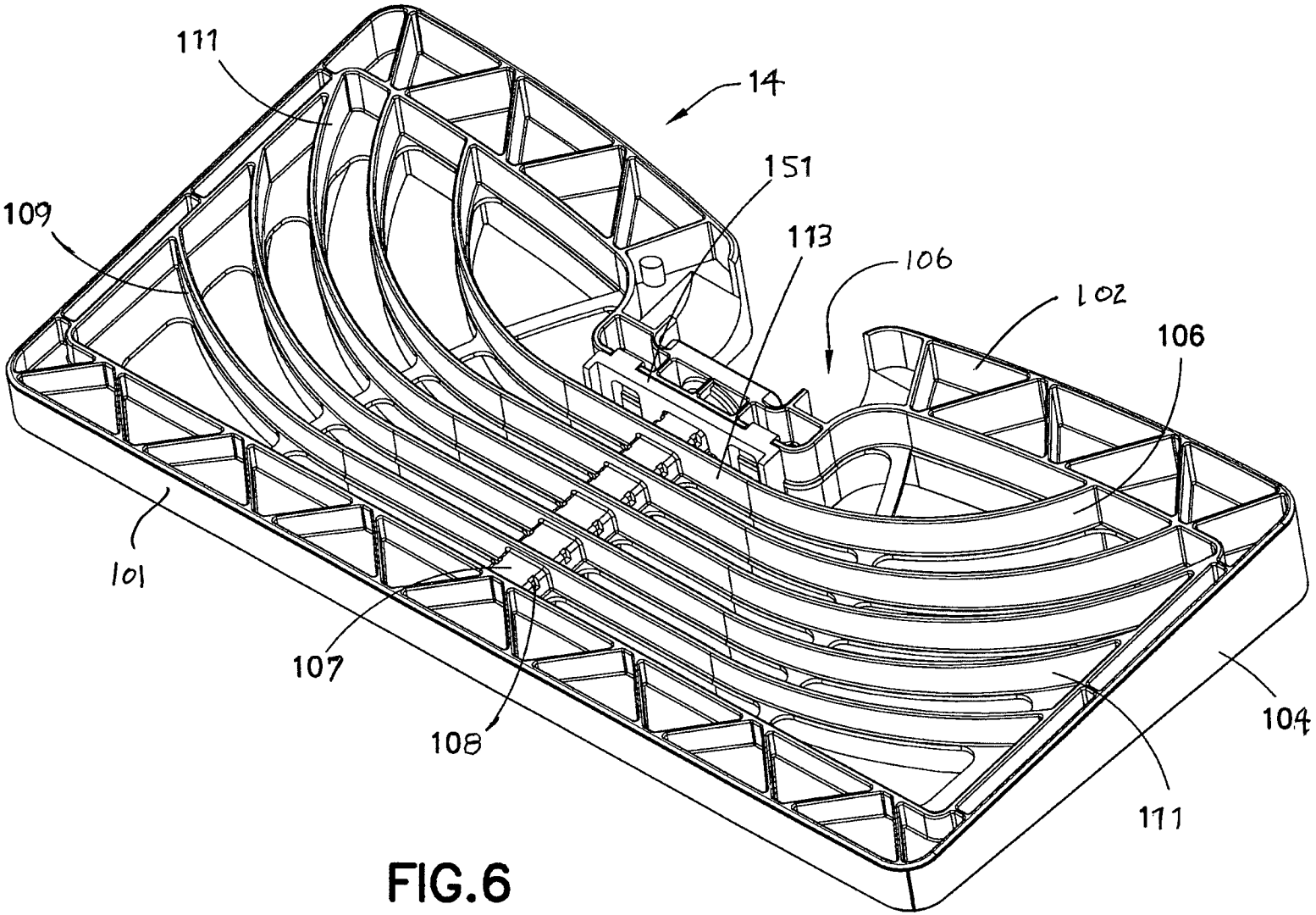
FIG. 6 is a perspective view of the rectangular steam pocket frame suitable for use with the type of steam mop shown in FIG. 1 with a fragrance diffuser attached.

FIG. 6 shows the details of steam pocket frame 14 having a front wall 101, an opposed rear wall 102, a right side wall 103 and left side wall 104. Rear wall 102 includes a cut-out section 106 for receiving connector 16. A steam distributor or manifold 107 extends from rear wall 102 to the front of frame 14 and connects connector 16 to the steam generated in boiler 23. Manifold 107 has steam openings 108 to distribute steam to both sides of frame 14. A plurality of interior baffles 109 extend from one side of frame 14 to the other side. Here, baffles 109 are curved at ends 111 and 112 and have a straight section 113 in the center so they are parallel and perpendicular when they cross manifold 107. A diffuser 151 in accordance with the invention is installed in frame 14 at cut out 106 in rear wall 102 across manifold 107.

Figure 7:
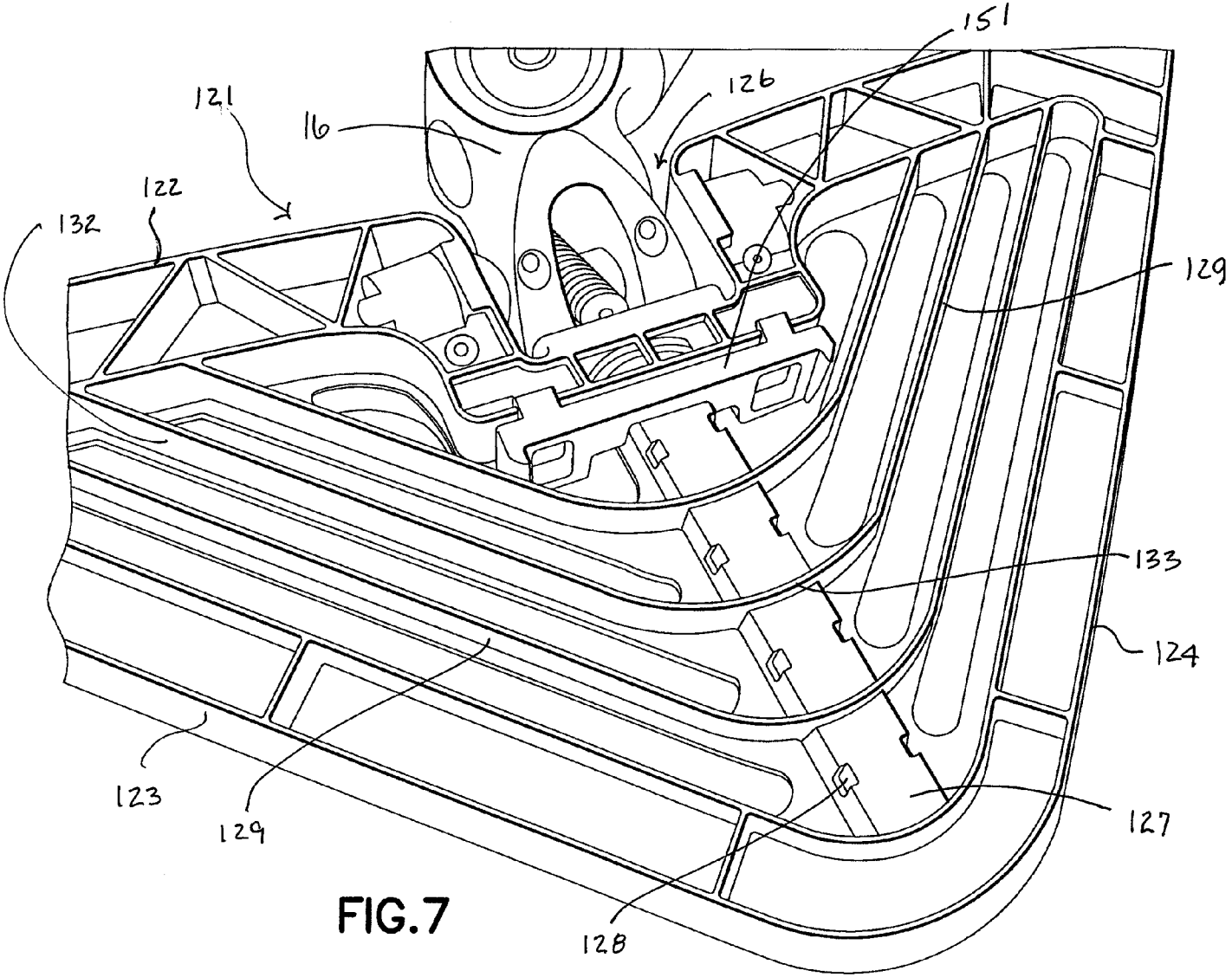
FIG. 7 is a perspective view of a triangular shaped steam pocket frame suitable for use with the type of steam mop shown in FIG. 1 with a fragrance diffuser attached.

FIG. 7 shows a triangular steam frame 121 having a rear wall 122 and two side walls 123 and 124 to form the triangular shape. Rear wall 122 has a cut-out section 126 for receiving connector 16. A steam distributor or manifold 127 with a plurality of steam openings 128 extends from cut-out 126 at rear wall 122 to the front of frame 121. A plurality of interior baffles 129 extend from one side of frame 121 to the other side. Here, baffles 129 are curved at ends 131 and 132 and have a straight section 133 in the center and are perpendicular when they cross manifold 127. Diffuser 151 is mounted on frame 121 at the base of triangular frame 121.

Figure 8:
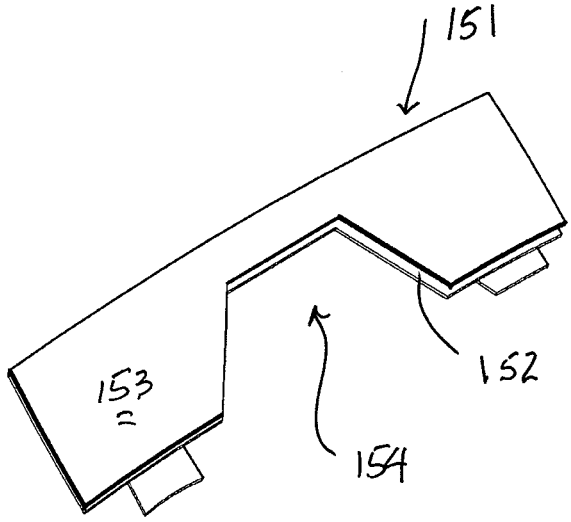
FIG. 8 is a plan view of the front side of the fragrance diffuser installed in the frames in FIGS. 6 and 7 including a fragrance absorbent material and mounting fingers.
Figure 9:
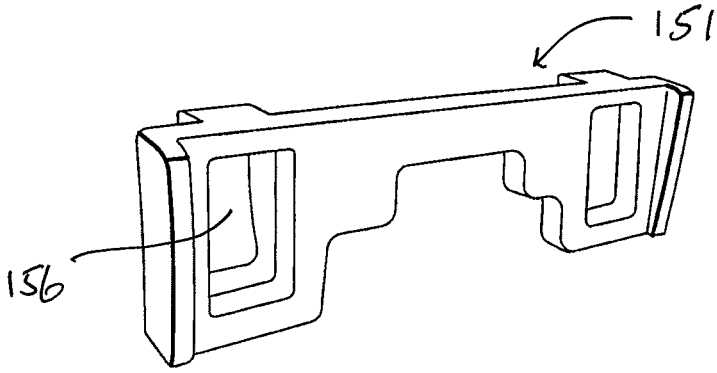
FIG. 9 is a perspective view of the front side of the fragrance diffuser.
Figure 10:
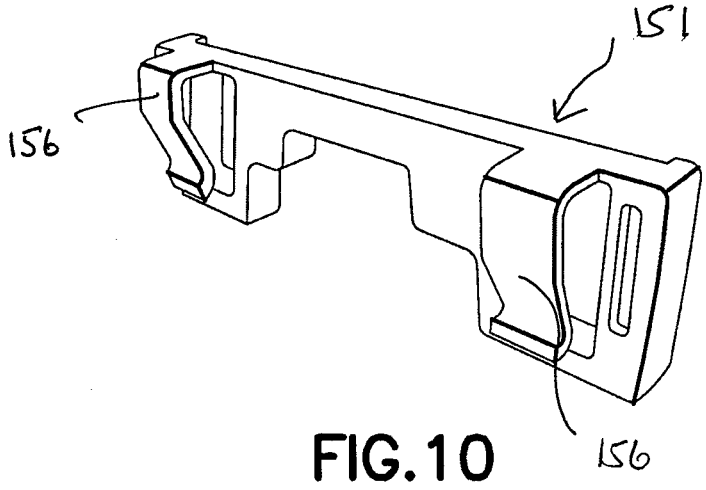
FIG. 10 is a rear perspective view of a fragrance diffuser showing the integral mounting fingers.

Diffuser 151 is shown in detail in FIGS. 8-10. Diffuser 151 is formed from an absorbable substrate material, such as a micro-porous polymer or a fiberboard. It is substantially planar with a rectangular diffuser base 152, or may have a piece of absorbent material secured on diffuser base 152. In the preferred embodiment of the invention, the substrate is formed from the absorbent substrate material formed into a single unitary piece.

As shown in FIGS. 9 and 10, diffuser base 152 is formed with a flat substrate face 153 with a cut-out region 154 to allow for mounting over a steam frame manifold. Diffuser base 152 may be formed in any convenient size, but should have a height no greater that the height of the side walls of frames 14 and 121. Diffuser base 152 is formed with two diffuser fingers 156 for a engaging a vertical frame member, such as an interior or outer side wall or baffle of a steam frame as shown in FIGS. 6 and 7. Each finger 156 is biased towards substrate face 153 so that when diffuser 151 is positioned on a vertical member in the frame, fingers 156 engage the vertical member to hold diffuser 151 in place.

Figure 11:
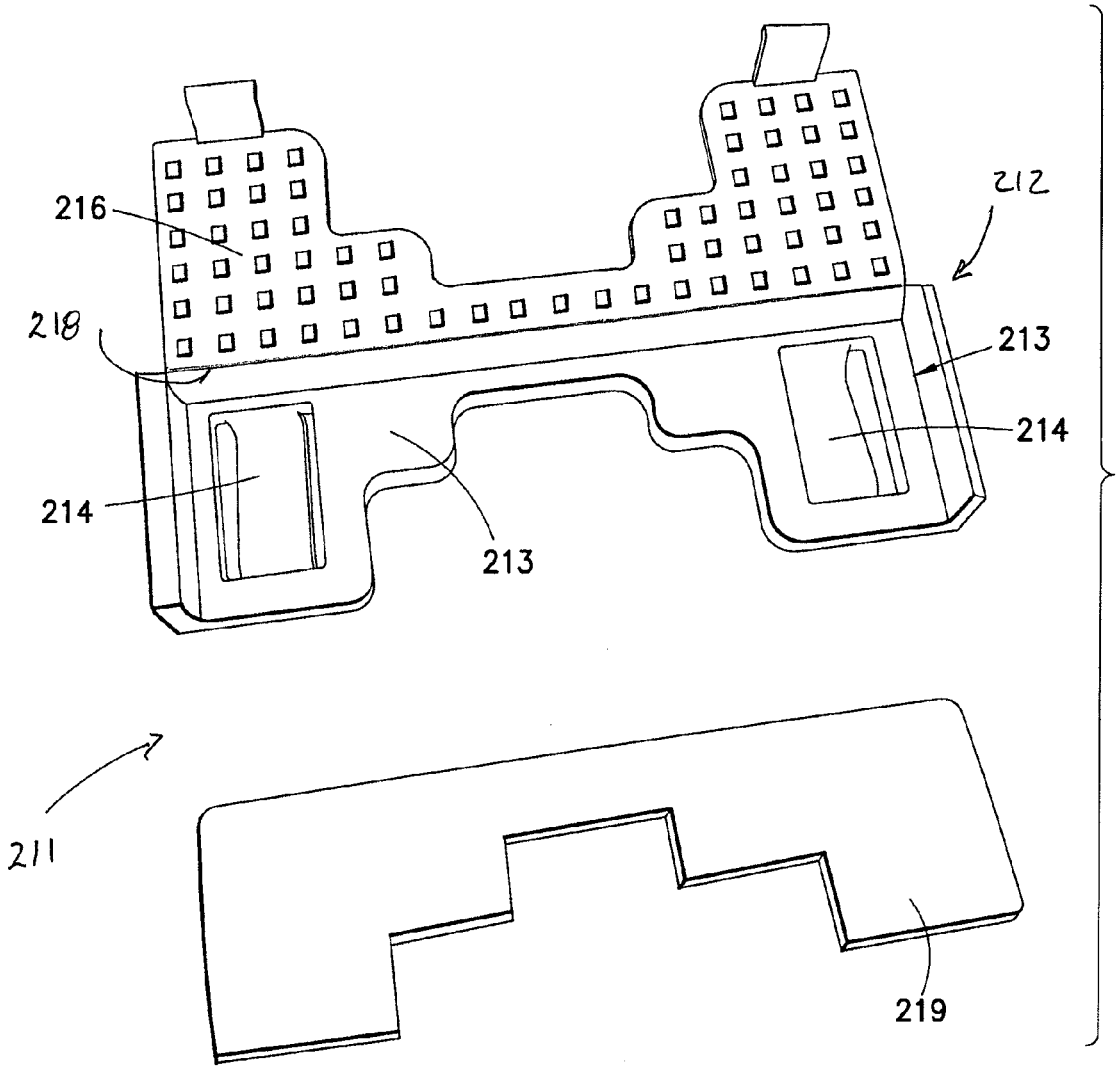
FIGS. 11-13 illustrate another form of a fragrance diffuser formed of a carrier and absorbent fragrance pad and its assembly.
Figure 12:
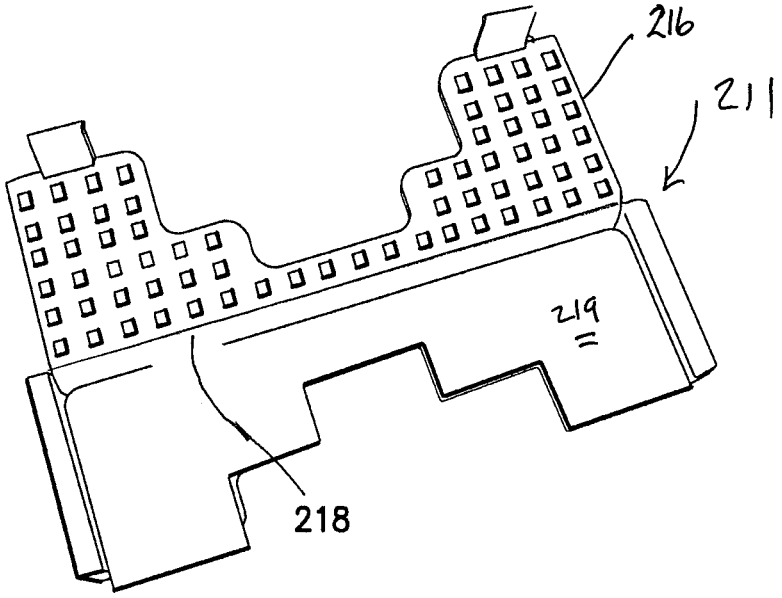
Figure 13:
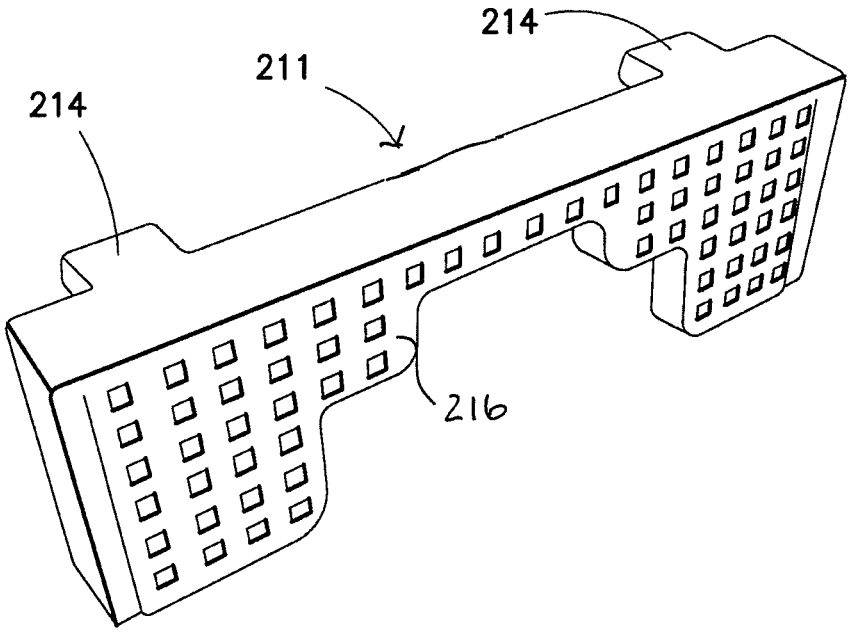

FIGS. 11-13 illustrate another fragrance diffuser assembly 211 formed from a carrier 212 having a base 213 with two mounting fingers 214 and a perforated cover plate 216 that is hinged to base 213 by a live hinge 218. A saturated fragrance pad 219 is placed on base 213 as shown in FIG. 12. Perforated cover 216 is closed over pad 219 as shown in FIG. 13. Once assembled, assembly 211 is installed on steam frame 14 or 121 over manifold 104 in the same manner as diffuser 111. This type of assembly allows a user to install fragrance diffuser 211 on a steam frame without having to touch adsorbent pad 219 that is saturated with fragrance.

Figure 14:
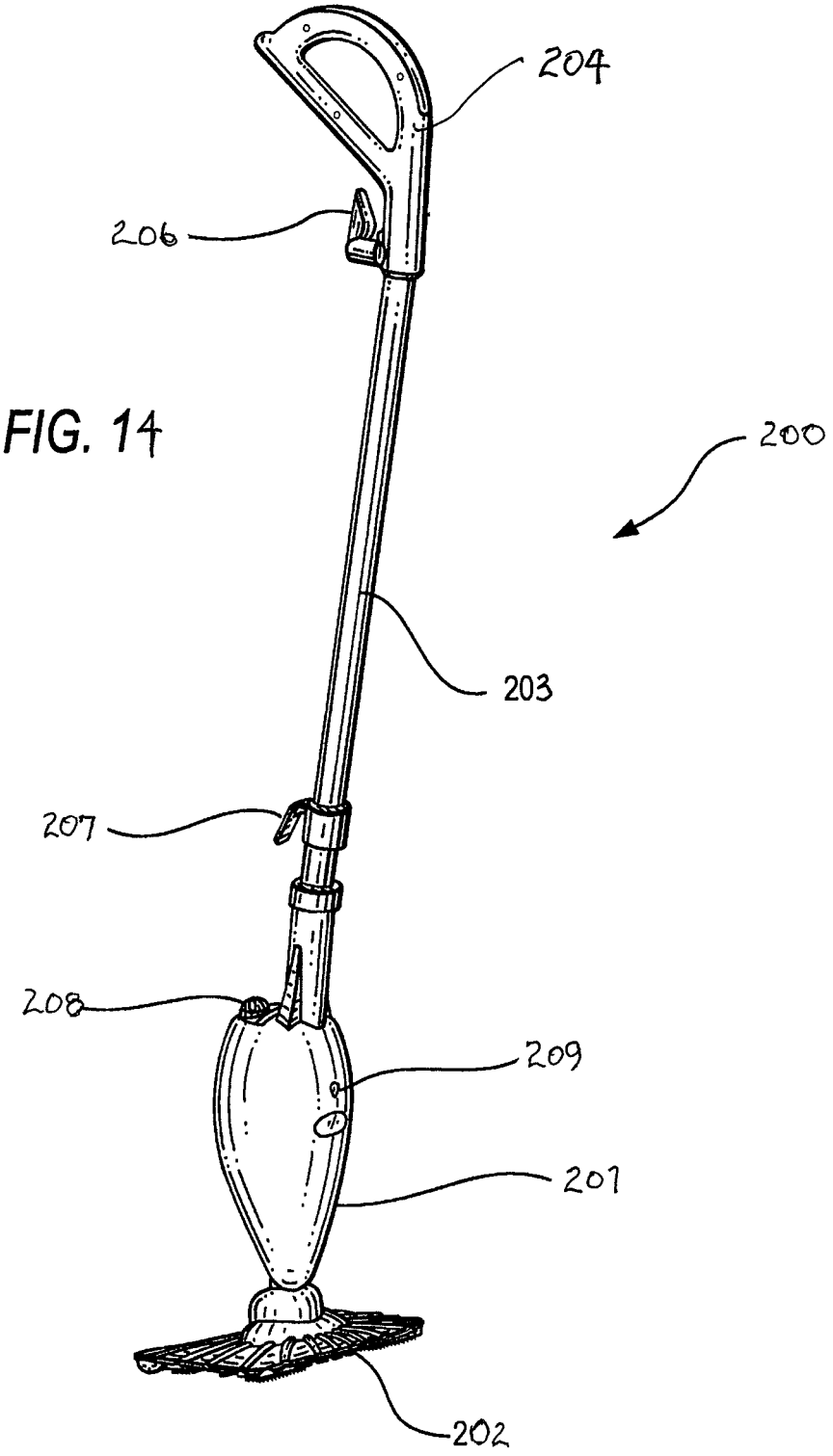
FIG. 14 is a perspective view of steam mop including a steam pad frame attachment for receiving a fabric steam pad.

FIG. 14 is a perspective view of a steam mop 200 having a housing or main body 201 connected to a steam pad frame 202 at one end and a pole 203 with a handle 204 at the other end of pole 203. Housing 201 includes a water container or tank 21 as shown in FIG. 3 as part of the upper part of housing 201 with a filler cap 208. Tank 21 is connected to boiler 23 by pump 22. An upper cord hanger 206 is mounted on handle 204 and a lower cord hanger 207 for easy storage of a power cord. Housing 201 includes an operating light 209 to indicate power is on.

Figure 15:
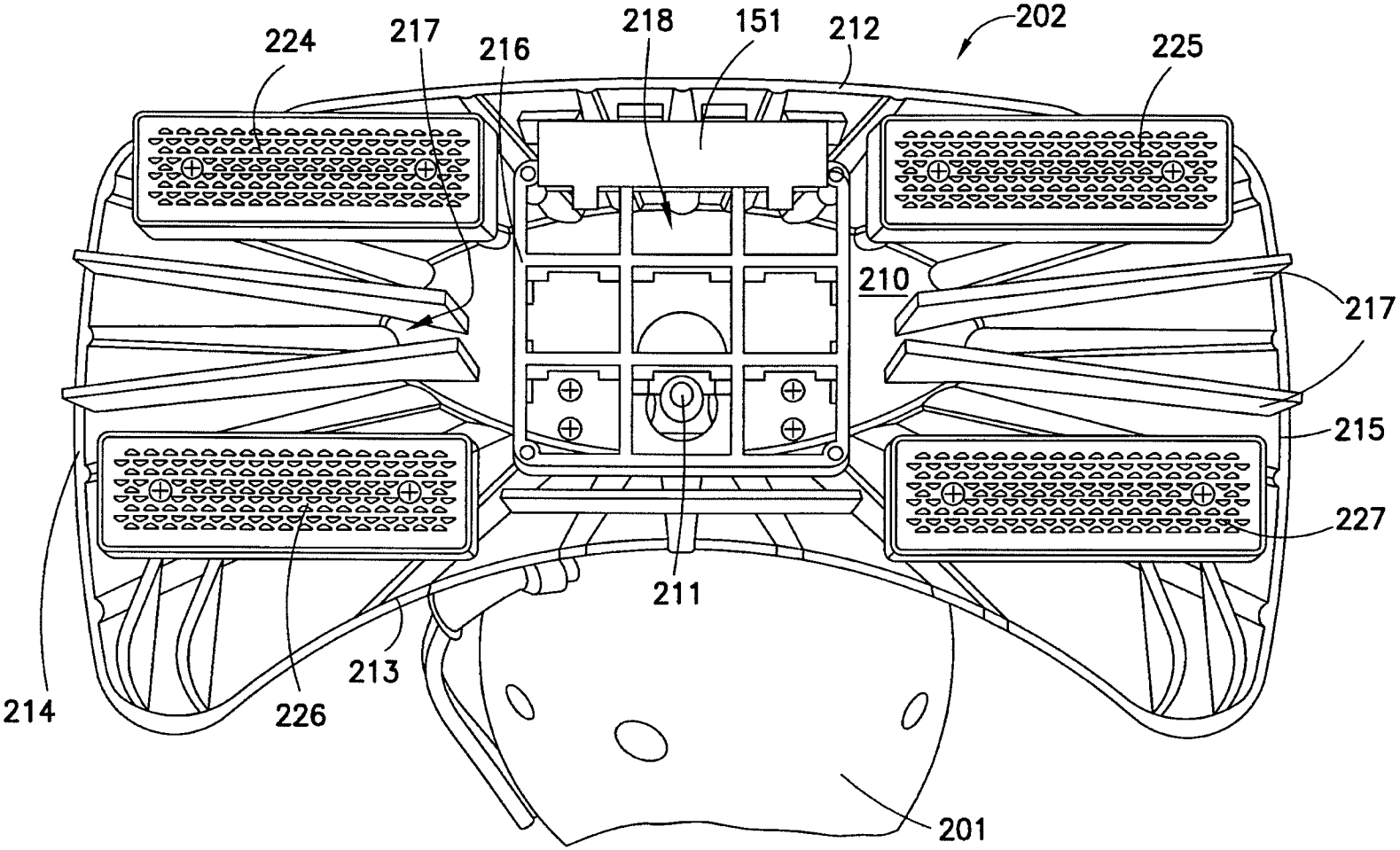
FIG. 15 is a bottom plan view of the steam pad frame of the steam mop of FIG. 14 with an installed diffuser.

Steam pad frame 202 is substantially rectangular in shape and includes a central steam opening 211 as shown in FIG. 15. Steam generated in steam boiler 23 dispenses steam into central steam opening 211 in a depression 210 formed in frame 202. A substantially rectangular fabric steam pad 221 is mounted on frame 202 by attaching a pair of Velcro strips 222 and 223 to a plurality of cleats 224, 225, 226 and 227 as shown in FIGS. 15 and 16.

FIG. 15 is a bottom plan view of rectangular steam pocket frame 202 with diffuser 151 installed. Frame 202 has a front edge 212, a rear edge 213, a right side edge 214 and a left side edge 215. A square grid formation 216 covers steam outlet opening 211 and a plurality of vanes or baffles 217 extend from depression 210 toward the four edges of steam pad frame 202. Grid 216 has a plurality of vents or openings 218 between the grid walls for distributing steam into the spaces between baffles 217 and to fabric steam pad 221 mounted thereon. Diffuser 151 is shown mounted on grid 216, but may be mounted on one of baffles 217. Steam pad frame 202 also includes runners 228 at each of the two rear corners thereof to facilitate sliding pad 221 on a surface to be steamed.

Figure 16:
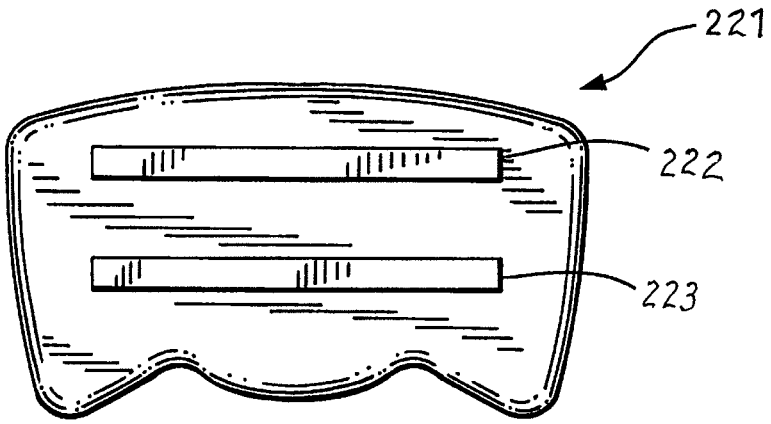
FIG. 16 is a top plan view of a fabric steam pad suitable for use with the steam pad frame attachment of FIG. 14.

FIG. 16 is a top plan view of fabric steam pad 221 suitable for use with steam pad frame 202. Steam fabric pad 221 is configured to attach to frame 202. Fasteners 203 are fixed to the top side. In the preferred embodiment, fasteners 203 are Velcro-type fasteners. Alternatively, other types of fasteners, such as clips or clamps may be used to secure and hold steam pad 221 in place when used to clean a floor or other surface.

In the illustrated embodiment, steam pad 221 is a cloth or towel. It may be formed of any suitable fabric such as cotton or a synthetic fabric, such as polyester or polyolefin fiber. Preferably, fabric of pad 221 is a microfiber. Most preferably, the microfiber is a synthetic polyester microfiber.

Figure 17:
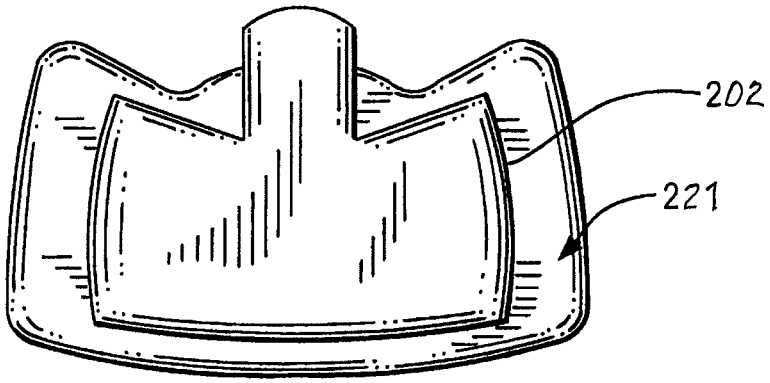
FIG. 17 is a top plan view of the frame of FIG. 15 with the fabric steam pad of FIG. 16 mounted on the frame.

FIG. 17 is a top plan view of the mop of FIG. 14 with fabric steam pad 221 mounted on frame 202. Here, fabric steam pad 221 is attached to steam pad frame 202 by fasteners (not shown). Also, in this example, fabric steam pad 221 is larger than steam pad frame 202 in order to provide increased steam cleaning surface area.

Fragrance diffuser 111 may be used with any steam appliance that uses a steam frame for distribution of steam and provides a suitable space for positioning the diffuser between the steam outlet and the fabric pad or steam pocket. The appliance may be a steam brush or a hand-held device of the type shown and described in U.S. application Ser. No. 12/540,957 and Ser. No. 12/617,518, the contents of which are incorporated herein in their entirety.

Diffuser 151 also may be installed in a flexible steam frame in accordance with the invention. Such frames with flexible steam frames may be used with hand-held appliances. Typically, the flexible steam frames have a handle mounted on a rigid base with a plurality of flexible members extending from the base away from the handle to form a skeleton with an interior space for receiving a fabric steam pocket. Examples of these flexible steam frames are described in U.S. application Ser. No. 12/554,477, the contents of which is incorporated herein in its entirety.

Figure 18:
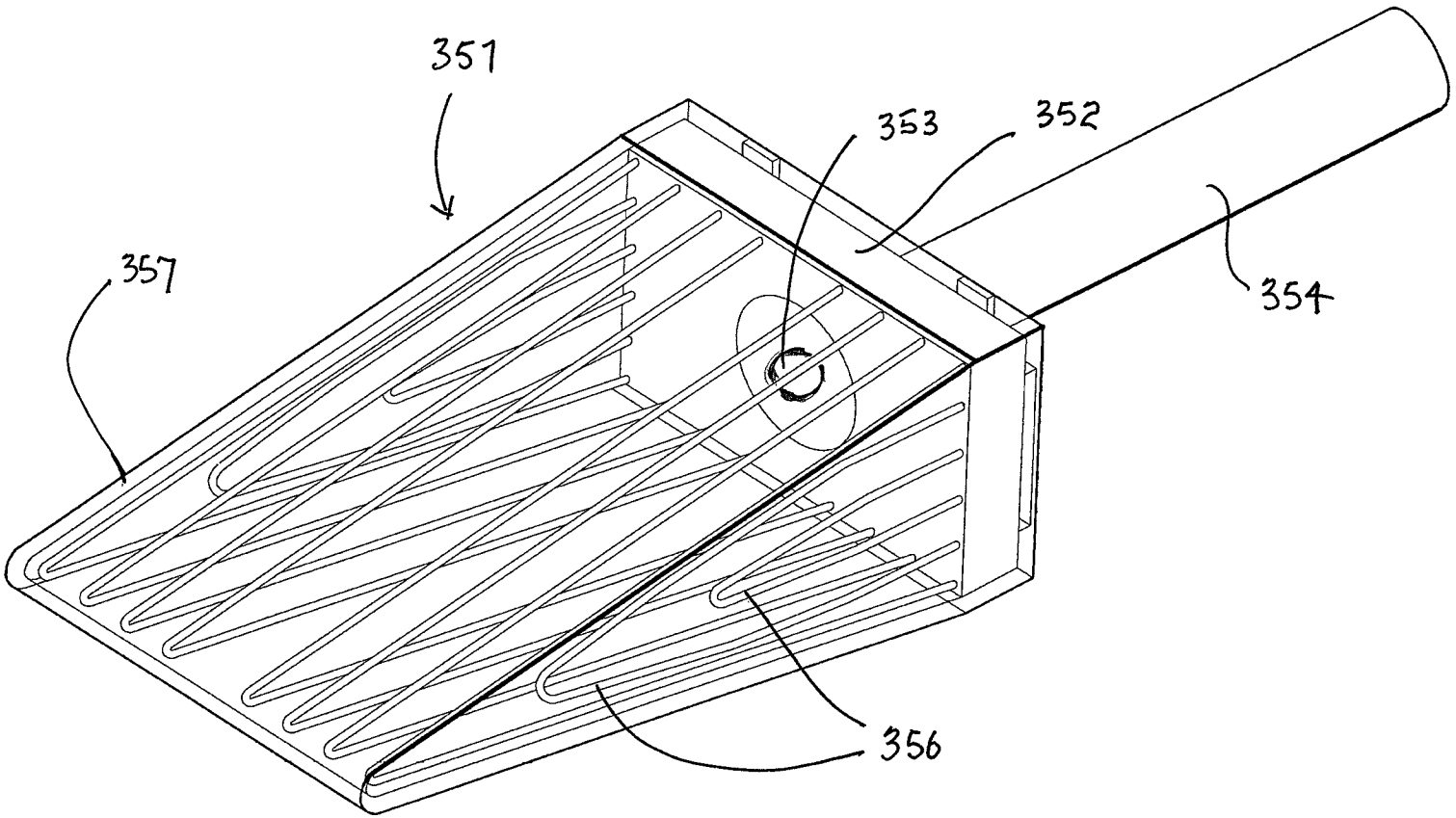
FIG. 18 is a perspective view of a flexible steam frame suitable to receive a fragrance diffuser in accordance with the invention.

One such wedge shaped flexible steam frame 351 is shown in FIG. 18. Flexible steam frame 351 includes with a base 352 having a steam outlet 353 and handle 354 mounted to base 352 with a steam outlet hose connected to outlet 353. A plurality of wires 356 for the wedge shape and have a fabric towel 357 or cloth in the form of a steam pocket positioned or slipped over wires 356 and base 352. The sole requirement is that the be a space between the steam outlet of the appliance and the fabric steam pocket to receive the diffuser containing the steam emitting composition.

Diffuser substrate 112 may be formed from any material the will hold a quantity of fragrance or other composition, such a disinfectant or the like. The fragrance or other composition is formulated to be released only at elevated temperatures generated by steam in the space created by fabric steam pocket 15 mounted on a steam frame or below frame 202 and pad 221. For example, the temperature in the space within steam pocket 15 have been measured to be between 175° F. to 195° F. (80°-90° C.). Thus, suitable release temperatures in the range of 140° F. to 195° F. (60°-90° C.) would be suitable. Preferable, the release temperature is between 140° F. to 160° F. (60°-70° C.).

Typically these compositions contain essential oils or gels and the release temperature can be controlled and made to vary widely. Substrate 112 may be any material, such as a fibrous or porous material capable of absorbing and releasing the fragrance composition. Such porous material may be carbon based or ceramic of the type disclosed in U.S. application Ser. No. 10/154,794 published as US 2002/0176949, the contents of which are incorporated herein by reference in its entirety. One such porous substrate is formed from a polyethylene material that has undergone a series of curing processes resulting in microscopic voids being formed therein. Such materials are disclosed in U.S. Pat. No. 4,181,255, the contents of which are incorporated herein by reference in its entirety.

The shape of the porous material used in diffuser 111 is not significant, but only that it can be secured to a steam frame inside the steam towel and that a quantity of fragrance or other composition can be absorbed and released at the temperature caused by the steam generated in the steam appliance and fed into the steam frame. It is preferable that the fragrance will not be released at lower temperatures and only when the steam appliance is generating steam for cleaning.

It will thus be seen that the objects set forth above, among those made apparent from the preceding description, are efficiently attained and, since certain changes may be made in the above product and device without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

The present invention may be embodied in other specific forms without departing from the spirit or essential attributes of the invention. Accordingly, reference should be made to the appended claims, rather than the foregoing specification, as indicating the scope of the invention.

What is claimed is:

1. A steam appliance, comprising:

an appliance housing including a steam generator and a steam outlet for the steam generated in the generator;

a steam frame connected to the housing and coupled to the steam outlet;

a fabric steam cloth mounted on the steam frame; and a diffuser having a composition absorbed therein and mounted on the frame between the steam outlet and the steam cloth, the diffuser including a substantially planar base and at least one finger biased towards the base to engage the steam frame.

2. The steam appliance of claim 1, wherein the diffuser is formed from a polymeric material having a plurality of microscopic voids.

3. The steam appliance of claim 2, wherein the polymeric material is suitable to release a composition at a release temperatures in the range of 140° F. to 195° F. (60°-90° C.).

4. The steam appliance of claim 1, wherein the diffuser includes a base with a polymeric substrate with microscopic voids mounted to the base.

5. The steam appliance of claim 4, wherein the diffuser is formed from the polymeric material.

6. The steam appliance of claim 1, wherein the composition is a fragrance.

7. The steam appliance of claim 1, wherein the composition is an antiseptic.

8. The steam appliance of claim 1, wherein fife composition is a cleaning solution.

* * * * *

UNITED STATES PATENT AND TRADEMARK OFFICE

CERTIFICATE OF CORRECTION

PATENT NO. : 8,667,637 B2
APPLICATION NO. : 12/651162
DATED : March 11, 2014
INVENTOR(S) : Vrdoljak et al.

It is certified that error appears in the above-identified patent and that said Letters Patent is hereby corrected as shown below:

**In the Claims:

Column 8, claim 8, Line 29, the word "fife" should read as: --the--.**

Signed and Sealed this
Seventeenth Day of June, 2014

Michelle K. Lee

Michelle K. Lee
*Deputy Director of the United States Patent and Trademark Office*